United States Patent [19]

Mokesch

[11] 3,954,353

[45] May 4, 1976

[54] AXIAL PISTON PUMP

[76] Inventor: Ludwig Anton Mokesch, Romerstrasse 31, 7580 Buhl, Baden, Germany

[22] Filed: Sept. 3, 1974

[21] Appl. No.: 502,292

[30] Foreign Application Priority Data

Sept. 17, 1973 Germany ..... 2346646

[52] U.S. Cl. ..... 417/269; 91/482

[51] Int. Cl.[2] ..... F04B 1/06; F04B 1/12

[58] Field of Search ..... 91/482; 417/270, 269

[56] References Cited

UNITED STATES PATENTS 2,160,978 6/1939 Mock ..... 417/269

3,074,345 1/1963 Scheflow ..... 417/270

FOREIGN PATENTS OR APPLICATIONS 1,127,829 7/1958 Germany ..... 91/198

*Primary Examiner*—William L. Freeh

*Attorney, Agent, or Firm*—Bacon & Thomas

[57] ABSTRACT

The invention relates to an axial piston pump comprising several piston-cylinder units actuated by means of an inclined disc. Said pump comprises a rotatably mounted inclined disc as well as a distributing slide in the form of an annular disc and eccentrically disposed relative to the pump axis, said slide connecting the outlet and inlet ports of the piston-cylinder units of the pump fixed in the rotating direction.

3 Claims, 5 Drawing Figures

AXIAL PISTON PUMP

This invention relates to an axial piston pump comprising several piston-cylinder units actuated by means of an inclined disc.

In the known pumps of that type, the operating surfaces are stressed by pressure, thereby leading to a premature wear and important oil losses owing to leakages. Even, when according to a known characteristic, a special pressure plate is incorporated, no substantial improvement is obtained since the plate must be frequently replaced. In addition, the operation of said pumps is relatively noisy and said pumps may neither reach very high rotating speeds nor be used as low speed engines.

In order to avoid these drawbacks, according to this invention, a rotatably disposed inclined disc is used, the drive being effected through a distributing slide in the form of an annular disc and mounted eccentrically relative to the pump axis, said distributing slide alternatively connecting the outlet or inlet ports of the piston-cylinder units fixed in the rotating direction with the pressure and suction sides of the pump.

In any case, the known axial piston pumps are adjusted by pivotably mounting the inclined disc, thereby modifying the capacity of the piston-cylinder units. This system is very expensive, it gives rise to a very important clearance in the transmission members and, in most cases, the modification of the piston stroke is more or less time consuming.

In order to prevent said drawback, according to a particularly advantageous and very simple further embodiment of the invention, an eccentric carrying the distributing slide and rotating with the inclined disc is disposed so that a shifting device may rotate it in its angular position relative to the inclined disc. It is then possible to quantitatively adjust the pump without modifying the capacity, i.e. in the case of a rigid inclined disc, only by rotating the eccentric by means of a handle or a simple servomotor driven in any manner, since the rotation of the eccentric is obtained by a corresponding rotation movement acting from the outside or by an axial movement which is converted into a rotating movement. According to the invention, the adjustment is in a manner obtained by a phase shifting of the mutually corresponding passage ports which are adjusted by the slide.

Owing to the small number of rotating parts, as compared with the known pumps, high rotating speeds are reached, the noise is lowered and a high degree of mechanical efficiency is obtained together with a good volumetric efficiency degree. In addition, this new pump may be used as a low speed pump.

In order to modify in any manner the angular position of the eccentric relative to the inclined disc with the view of effecting a quantitative adjustment, according to a particular embodiment of the invention, a two portion pump shaft is used, the first portion connected to the drive of the pump carrying the inclined disc, while the second portion which carries the eccentric while preventing it from rotating and allowing it to slide axially, is disposed to slide and rotate relative to the first portion. In that case, the eccentric is mounted on the second portion of the shaft by means of longitudinal teeth.

Considering that, a portion of the shaft comprising a helical groove of an important pitch engaged by at least a length of the other portion of the shaft, the corresponding portion of the pump shaft must be axially shifted only with small forces either by hand or by means of a motor for adjusting the desired angular position between the inclined disc and the eccentric.

An embodiment of the invention is illustrated by way of example in the enclosed drawings in which.

Figure 1:
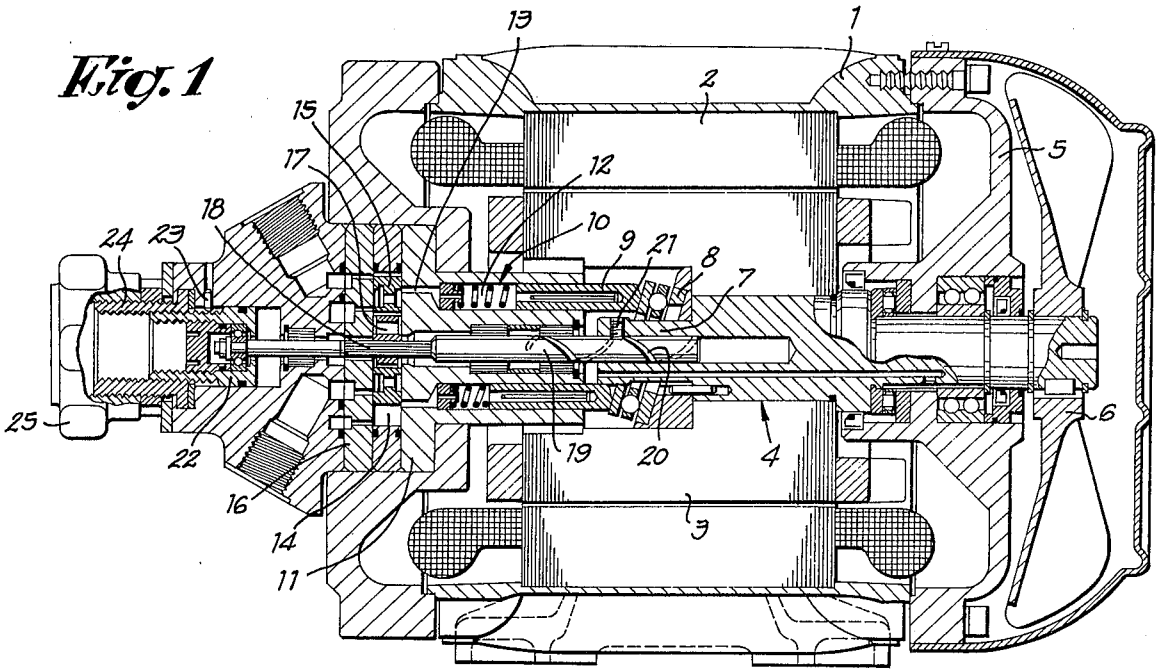
FIG. 1 is a longitudinal section of a new axial piston pump combined with an electrical driving motor.

The motor housing 1 of the pump connected with an electrical motor includes the stator 2 in which the rotor 3 rotates and the rotor shaft 4 which is mounted in the cover 5 of the housing outside which the fan 6 is carried on the above shaft. In addition, the rotor shaft 4 forms the first portion 7 of the two portion pump shaft, the inclined disc 8 being firmly wedged on the said first portion. The inclined disc 8 cooperates with the piston 9 (spring loaded) of the piston cylinder units 10 situated in the pump housing 11 which is prevented from rotating. The cylinders 12 are connected through channels 13 with the compartment 14 in which the distributing slide 15 is mounted. The said compartment 14 is formed, on one hand, by the outer surface of the housing 11 including the piston-cylinder units 10 and, on the other hand, by the inner surface of the disc 16 forming the cover of the pump housing. In said surfaces, are provided the ports of the channels 13 which are connected with the cylinders 12 as well as the ports communicating with the pressure and suction sides of the pump. The above surfaces form bearing surfaces for the distributing slide 15. The distributing slide is mounted on an eccentric 17 which, in turn, lies on longitudinal teeth 18 of the second portion 19 of the pump shaft, while being axially movable. The above ports provided in the bearing surfaces of the distributing slide 15 are corresponding to each other according to the position of said distributing slide or of the eccentric outside the slide 15 or above the perforations provided inside the latter.

On the second portion 19 of the shaft, is provided a helical groove 20 with which a part, e.g. a pin 21 of the first portion 7 of the shaft cooperates so that, when the portion 19 is longitudinally shifted, a relative movement is imparted thereto in the rotating direction relative to the first portion 7 of the shaft. Owing to said relative movement, the angular position of the eccentric 17 relative to the inclined disc 8 is modified and, accordingly, the throughput between the cylinders 12 and the suction and pressure sides of the pump through the compartment 14 is adjusted by means of the distributing slide 15. With the view of longitudinally shifting the portion 19 of the shaft, the free end thereof is mounted in a piston 22 guided in the cover disc 16 which is prevented from rotating by means of a pin 23. A threaded sleeve 24 carrying an adjusting wheel 25 threadedly engages the piston 22. When the sleeve 24 is rotated, the piston 22 and, as a result, the portion 19 of the shaft are caused to slide axially and the above described adjusting effect is obtained. On the other hand, the sliding movement of the shaft portion 19 may be also effected by any servo-motor operating in the rotating direction or with a reciprocating movement.

Figure 2:
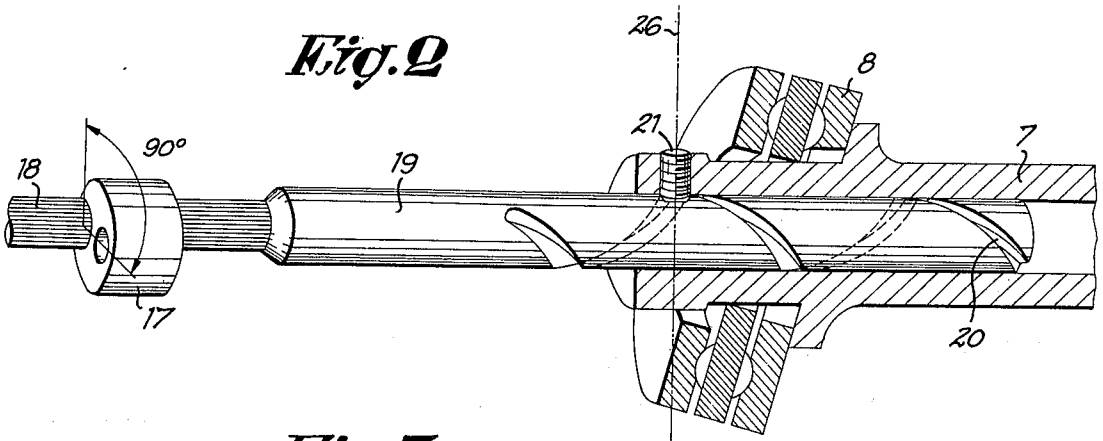
FIGS. 2 to 4 are perspective views of the shifting path of the eccentric carrying the distributing slide in various adjusted positions.
Figure 3:
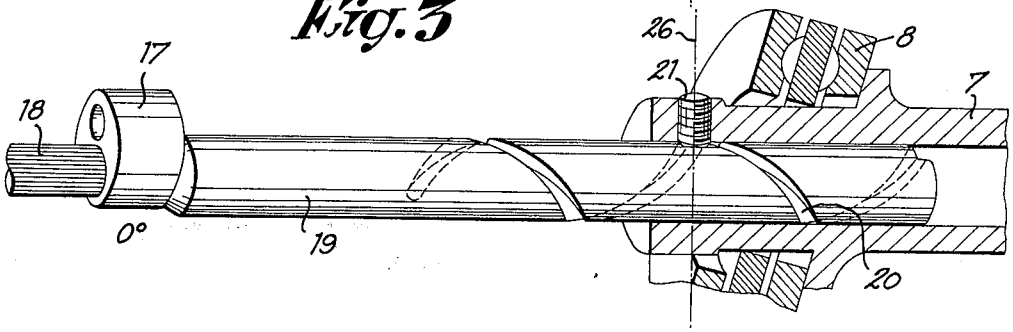
Figure 4:
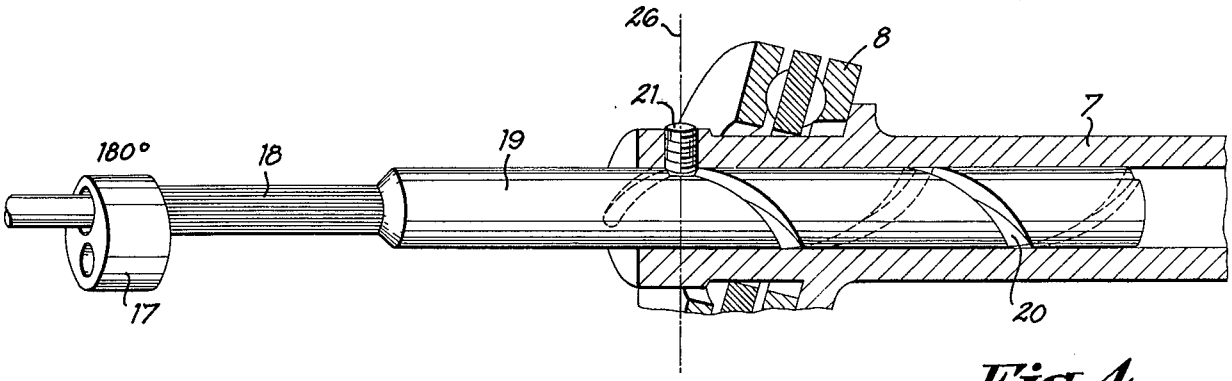
Figure 5:
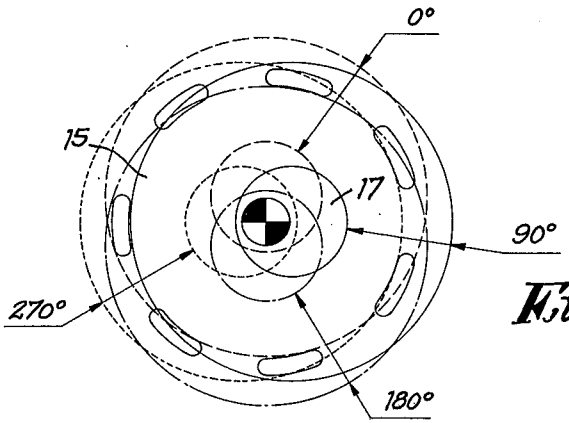
FIG. 5 is a front view of the distributing slide, the various positions being indicated.

FIGS. 2 to 5 show the various positions of the adjusting device. FIGS. 2 to 4 show these different positions of the second shaft portion 19 which may be axially shifted and on the longitudinal teeth 18 of which lies the eccentric 17. In the position of FIG. 2, the eccentric 17 lies in a position forming an angle of 90° relative to the vertical or relative to an imaginary axis 26 of the inclined disc 8. In this position, the distributing slide (not shown in the descriptive drawings) occupies a position in which the maximum throughput is obtained. When the second portion 19 of the shaft slides into the position shown in FIG. 3, the position of the eccentric 17 is modified while forming an angle of 0° relative to the imaginary axis 26, the throughput being zero in said position i.e. the medium being pumped circulates without being discharged. An additional shifting of the shaft portion 19 to the position shown to FIG. 4 causes the eccentric 17 to rotate in an angular position of 180° in which the throughput is again zero and, as can be seen in FIG. 5, said eccentric reaches its maximum position at 270°, but in the reverse rotating direction of the pump.

What I claim is:

1. Axial piston pump including:

a housing;

a shaft rotatably mounted in said housing and having a first portion and a second portion, both portions having a common longitudinal axis;

a plurality of axially extending cylinders having their longitudinal axes arranged in parallel relation, said cylinders having inlet ports and outlet ports;

a piston reciprocable in each of said cylinder;

an inclined swash plate mounted on said first shaft portion and engaging said pistons so as to produce a reciprocating motion of said pistons upon rotation of said first shaft portion;

an eccentric member mounted on said second shaft portion in such a manner that it is slidable but not rotatable thereon;

an annular distributing member mounted on said eccentric member and arranged to control said inlet and outlet ports;

a reciprocating shifting device coupled with said second shaft portion to impart a reciprocating motion to said second shaft portion;

and means intercoupling said first and second shaft portions in such a manner that a longitudinal shift of said second portion produced by said reciprocating shifting device imparts an angular movement to said second shaft portion and therefore to said eccentric and to said distributing member.

2. An axial piston pump according to claim 1, wherein said first shaft portion has a pin, said second shaft portion having a helical groove wherein said pin is engaged.

3. An axial piston pump according to claim 1 wherein said housing has an outer surface through which said inlet ports and said outlet ports extend, and a cover having an inner surface defining ports for connection with pressure and suction sides of the pump, the ports of both surfaces corresponding to each other according to the position of said annular distributing member.

* * * * *